US009964376B2

(12) United States Patent
Odle et al.

(10) Patent No.: US 9,964,376 B2
(45) Date of Patent: May 8, 2018

(54) BORE EXTENDER FOR ACCURATE SIGHTING AND CONTINUOUS INDEXING

(71) Applicant: General Manufacturing, LLC, Columbia, MO (US)

(72) Inventors: Nathan Odle, Columbia, MO (US); Sam Campbell, Jefferson City, MO (US); Richard Martin, Columbia, MO (US)

(73) Assignee: General Manufacturing, LLC, Columbia, MO (US)

( * ) Notice: Subject to any disclaimer, the term of this patent is extended or adjusted under 35 U.S.C. 154(b) by 0 days. days.

(21) Appl. No.: 15/391,628

(22) Filed: Dec. 27, 2016

(65) Prior Publication Data

US 2017/0184367 A1 Jun. 29, 2017

Related U.S. Application Data

(60) Provisional application No. 62/271,825, filed on Dec. 28, 2015, provisional application No. 62/355,777, filed on Jun. 28, 2016.

(51) Int. Cl.
*F41A 21/32* (2006.01)

(52) U.S. Cl.
CPC ..... *F41A 21/325* (2013.01)

(58) Field of Classification Search
CPC ..... F41G 11/001; F41C 27/00; F41C 27/18; F41A 21/325; F41A 21/48
See application file for complete search history.

(56) References Cited

U.S. PATENT DOCUMENTS

| | | | | |
|---|---|---|---|---|
| 7,353,740 | B1 * | 4/2008 | Hoffman | F41A 21/26 42/107 |
| 7,610,710 | B2 * | 11/2009 | Brittingham | F41A 21/325 181/223 |
| 8,739,450 | B2 * | 6/2014 | Piontek | F41A 21/10 42/77 |
| 8,806,799 | B1 * | 8/2014 | Gordon | F41G 1/01 42/130 |
| 9,182,187 | B1 * | 11/2015 | Griffith | F41A 21/32 |
| 9,261,318 | B2 * | 2/2016 | Wood, Jr. | F41A 21/325 |
| D795,378 | S * | 8/2017 | Huang | D22/108 |
| 2007/0095198 | A1 * | 5/2007 | Dater | F41A 21/325 89/14.2 |

(Continued)

FOREIGN PATENT DOCUMENTS

WO WO-2007128346 A1 * 11/2007 ..... F41C 27/18

*Primary Examiner* — Benjamin P Lee
(74) *Attorney, Agent, or Firm* — The Law Firm of Brett M. Maland

(57) ABSTRACT

The current system is a method for easily attaching firearm devices to the end of a firearm. The system is used to improve the relative alignment between firearm devices and the bore of the firearm. The system solves the problem of non-uniformity when attaching devices to a firearm, by providing a uniform mounting surface. The system includes three main parts: a muzzle extender, a device, and a clamping method. The extender includes a threaded female receptor for attaching to the firearm muzzle and a clamping surface to be used with a clamping method to attach the device. The system has multiple embodiments including, built in muzzle devices, different clamping methods, and multiple devices to attach to the system.

2 Claims, 9 Drawing Sheets

(56) References Cited

U.S. PATENT DOCUMENTS

| | | | | |
|---|---|---|---|---|
| 2009/0044439 | A1* | 2/2009 | Phillips | F41C 23/14 42/72 |
| 2011/0154711 | A1* | 6/2011 | Dickerson | F41A 21/325 42/107 |
| 2012/0137563 | A1* | 6/2012 | Ubl | F41A 11/02 42/75.03 |
| 2013/0160637 | A1* | 6/2013 | Ahn | F41A 9/60 89/33.4 |
| 2013/0180797 | A1* | 7/2013 | Dueck | F41A 21/30 181/223 |
| 2013/0199071 | A1* | 8/2013 | Lee | F41A 21/325 42/76.01 |
| 2015/0135572 | A1* | 5/2015 | Davies | F41C 23/16 42/71.01 |
| 2015/0135575 | A1* | 5/2015 | Wood, Jr. | F41A 21/325 42/90 |
| 2016/0161214 | A1* | 6/2016 | Eble | F41G 11/003 42/90 |
| 2016/0348990 | A1* | 12/2016 | Steil | F41A 5/18 |
| 2017/0205176 | A1* | 7/2017 | Whitson | F41A 21/325 |
| 2017/0284760 | A1* | 10/2017 | Maffett | F41A 21/48 |

* cited by examiner

BORE EXTENDER FOR ACCURATE SIGHTING AND CONTINUOUS INDEXING

CROSS REFERENCE TO RELATED APPLICATION

This application claims priority to 62/271,825 titled SYSTEM FOR ATTACHING ACCESSORIES TO A FIREARM filed on Dec. 28, 2015 and 62/355,777 tided filed on Jun. 28, 2016 SYSTEM FOR ATTACHING ACCESSORIES TO A FIREARM.

FIELD

This invention relates to firearms and firearm accessories, specifically to device networks for attaching accessories and other devices to the threaded muzzle of a firearm barrel.

BACKGROUND

Systems exist for attaching accessories to threaded firearms barrels, such as found on the AR-15. However, the method in which accessories are attached is limited to three general solutions. One solution is to provide female threading on the accessory to attach to the threaded barrel, but this results in limited or no indexing, wherein indexing consists of rotating a device such as a sight around the barrel. When a state of the an female threaded device is attached to a male threaded bore, the rotational position of the device relative to the gun barrel is set wherever the threads align to provide a tightened fit. A second solution is to attach the accessory rearward on the barrel but this puts the front sight too close to the rear sight, which sacrifices accuracy. The standard AR-15 comes affixed with, a sight clamped to the barrel at the recoil gas port which does not provide a proper sight radius for maximum precision. As handguard development proceeded handguards became long enough to cover the gas port, which provided a third general solution. In the event of a handguard covering the gas port a front sight is attached to the handguard instead of the barrel. While the handguard is customizable and allows options for attaching the front sight, this solution also has problems. Attaching a front sight to an extended handguard allows for misalignment relative to the bore of the firearm when forces are applied to the handguard because the handguard moves relative to the bore of the firearm. Although this relative movement is minimal, the effects on aim can be compounded at long distances. To provide a truly accurate accessory, the accessory and the bore of the firearm must never move relative to each other. However, with AR-15s, the firearm bore comes in a wide variety of outside diameters, so that accessories are not available that fit around the barrel. This is an issue with sights, because it prevents continuous indexing. Silencers and other devices that attach to a bore do not provide a consistent attachment surface that properly provides the ability to attach a wide variety of accessory products, such as sights.

Current products do not allow accessories to be fixed to the barrel at any angle around the bore of the firearm, referred to herein as continuous indexing, which limits the user of the firearm to few angles for accessory mounting. Current methods of attachment involve threading a muzzle device to a gun barrel while sandwiching a crush washer. A shooter wanting to rotate the muzzle device to a different angle must loosen the muzzle device and remove the muzzle device and then replace the crush washer. Further, this method involves different torque on the muzzle device depending on the angle, not guaranteeing an appropriate torque can be achieved at the desired angle. This is because, when threading the muzzle device, the point of optimal tension created by the threading does not necessarily match up with the desired angle for the muzzle device. Further, if the muzzle device is to be realigned then a new crush washer must be used. Spacing washers can also be used to create a correct index angle for the accessory but must also be replaced if a new angle is desired. If an accessory needs to be indexed rapidly and efficiently neither crush washers or spacing washers provide the ability to do so.

SUMMARY

The invented device network described herein provides a muzzle extender with a uniform mounting surface for attaching firearm accessories, herein described as the device network's "devices," and in the preferred embodiment, front sights, solving the problem that is created when devices can only utilize the muzzle threads or the handguard as a direct attachment method. This device network, or system, allows devices to be manufactured with a single mounting mechanism, and provides the shooter with the ability to index the device at any angle around the bore, positions the device so there is no relative movement between the bore of the firearm and the device, and positions devices to the muzzle of the firearm that have previously been attached at other positions such as the handguard. The shooter can position the device around the muzzle quickly, and can quickly and easily re-index without removing any components from the system, only loosening. The system provides all of these advantages into one compact standard that can be used for multiple types of devices, on any firearm that provides muzzle threading due to the innovative means of extending a threaded firearm barrel.

The system provides better alignment with the bore of the firearm by allowing devices to be attached so that the aforementioned device will, not move relative to the bore of the firearm, increasing the effectiveness of alignment critical devices such as sights and while also allowing the device to be continuously indexed. This is accomplished by the device being directly clamped to an extender that is rigid, small, and directly attached to the barrel and has inventive features to allow a device to be secured and capable of continuous indexing. The system, including the device, being attached to the muzzle, will move with the muzzle when the firearm is put under load by the same magnitude and direction, thereby staying aligned. In one embodiment of the invention, firearm combustion gases are routed out the distal end of the extender in favorable directions thereby creating more uniformity in the alignment of the device and the projectiles trajectory.

The system provides continuous indexing about the bore axis by clamping the device to the extender at any angle and can be adjusted as needed. This allows the user to not only lock the device in the 12 o'clock position, as with traditional sights and most devices, but to be indexed at any angle, providing a custom fit for every shooter and accessory. This is particularly useful if a shooter wishes to realign their devices to avoid line of sight conflicts with other devices further back on the firearm.

The system allows the attachment of a device to the muzzle of the firearm, providing a maximum distance between the front and rear devices in systems where increased distance between two devices, such as sights, increases the effectiveness of the devices.

The construction designed to carry out the system will hereinafter be described, together with other features thereof.

The system will be more readily understood from a reading of the following specification and by reference to the accompanying drawings forming a part thereof, wherein an example of the system is shown and wherein

DETAILED DESCRIPTION OF DRAWINGS

Figure 1:
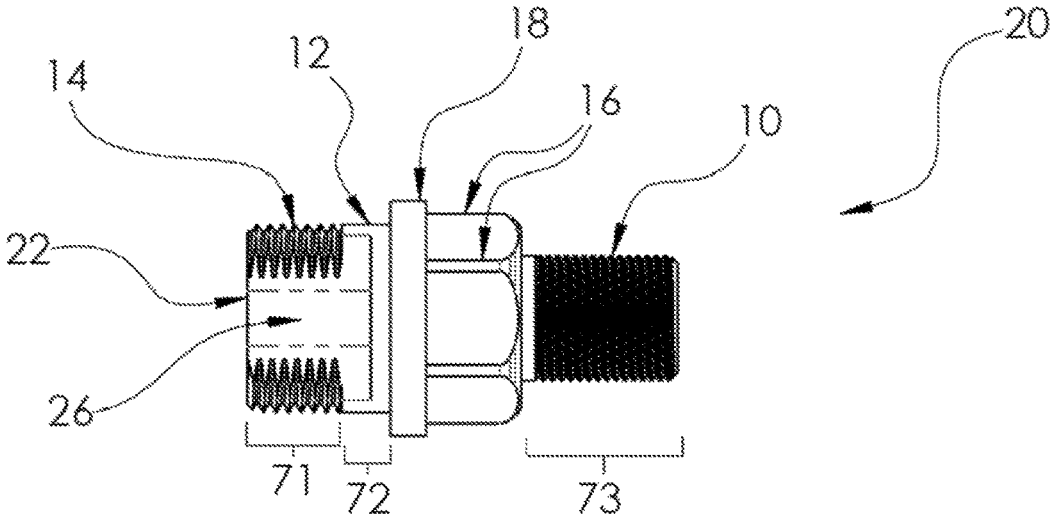
FIG. 1 is a side view of the extender showing the outer features of one embodiment.
Figure 2:
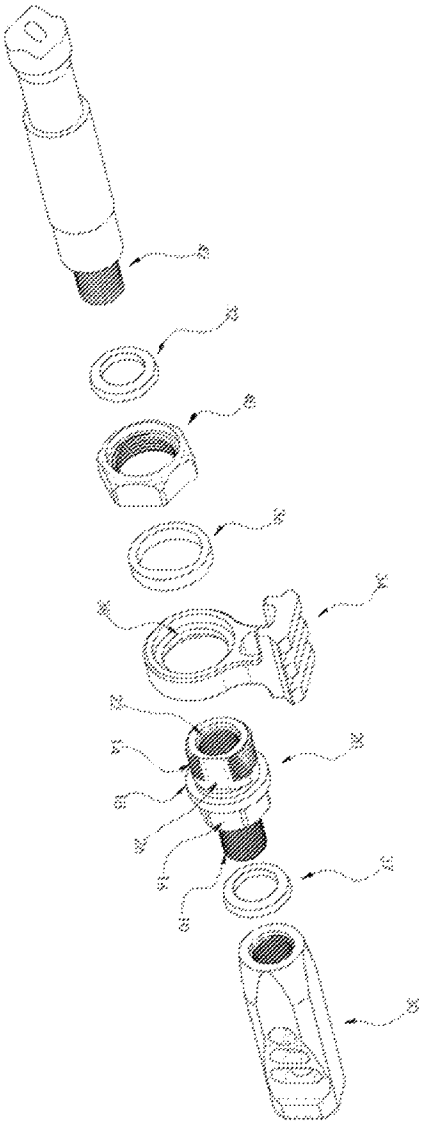
FIG. 2 is an exploded perspective view of one embodiment of the system showing all parts.

FIG. 2 displays an exploded view of the firearm extending system that is attached to the threaded portion of a firearm barrel 42. The system includes an extender 20 detailed in FIG. 1, which can be threaded onto a threaded firearm barrel 42. A device 34 that attaches to a barrel by surrounding the barrel, such as a picatinny rail or front sight is placed onto the extender. A washer 36 with one or more flats is then placed onto the extender 20 in alignment with one or more extender flats 26 on the extender. A clamping nut 40 is the threaded onto the extender 20 via the male threads 14 that are capable of being coupled to the clamping nut 40. When torque is applied to the clamping nut 40 to thread towards the device 34, the clamping nut 40 applies a force to the washer 36 which clamps the device to the extender 20 without applying a torque to the device 34, as the torque is instead applied to the clamping nut 40 and the extender, and the torque applied to the extender is explained by referring also to the detail of FIG. 1. The lack of torque applied to the device allows for accurate and consistent rotational placement.

The extender 20 is comprised of a proximal end 71, a middle 72, and a distal end 73 as shown in FIG. 1. The proximal end 71 further comprises a female threaded receptor 22 surrounded by male threads 14. The middle 72 further comprises a mounting surface 12 that is circular and allows for continuous indexing. The middle further comprises the flats section 26 comprised of one or more flats that will correspond to the washer 36 shown in FIG. 2. The middle further comprises a clamping surface 18 that abuts a device when in use. The clamping surface 18 abuts a device even if there are extra washers or other extra materials between the clamping surface and the device. The device will be sandwiched between the clamping nut 40 and clamping surface 18, and the device will not rotate since the washer 36 will not rotate due to the corresponding flats sections. The distal end further comprises a torque section 16 and, in the most preferred embodiment, male threading 10. In the preferred embodiment, the torque section 16 is comprised of a plurality of flats. In other embodiments, the torque section 16' can have just one flat and fit a specialized tool, just as the torque section 16' shown in FIG. 7.

Before the extender is threaded onto the threaded barrel of the firearm 42, a crush washer 32 is placed onto the threaded barrel 42. Then, the device 34, such as a picatinny rail, then the washer 36, then the clamping nut 40 are, placed on the middle 71 and proximal end 72 of the extender 20. Then, the female threaded receptor 22 is threaded onto the threaded barrel 42. The crush washer is then crushed via applying an appropriate torque to the extender 20 at the torque section 16 to screw the extender onto the threaded barrel 42. The extender 20 is securely coupled to the threaded barrel but the clamping nut 42 is able to move back and forth on the threads of the males threads 14 on the proximal end 71 of the extender.

Allowing the clamping nut to move freely while the extender is securely coupled to the threaded barrel 42 has a distinct advantage of allowing for continuous indexing of a device, such as a picatinny rail 34, with only minimal adjustment and without removing an element of the system. The continuous indexing is made possible by the configuration, in that the clamping nut will squeeze a device, such as a picatinny rail 34, onto an extension of the firearm bore. With this invention, the clamping nut can simply be loosened and the device can be rotated. After the device is rotated to the desired angle, the clamping nut 40 is tightened to lock in the device angle, allowing for rapid adjustment in the field.

The torque section 16 consists of a plurality of flats that allow for a wrench to apply torque and to turn the extender by turning the torque section 16. The second crush washer 37 applies a continual force to the system to prevent it from loosening. Once the system is attached a muzzle device 30 such as a muzzle brake can be attached. The extender 20 provides the same threading for mounting muzzle devices 30 as were present on the firearm muzzle 42 before the system was attached. After installation, the clamping nut 40 can be tightened to lock the device 34 position or loosened to allow the device 34 to be indexed to any angle. Once the correct angle is achieved the clamping nut 40 is then tightened against the washer 36 to clamp the device 34 at the selected angle. The washer 36 has one or more flats that mate to the one or more extender flats 26.

Figure 3:
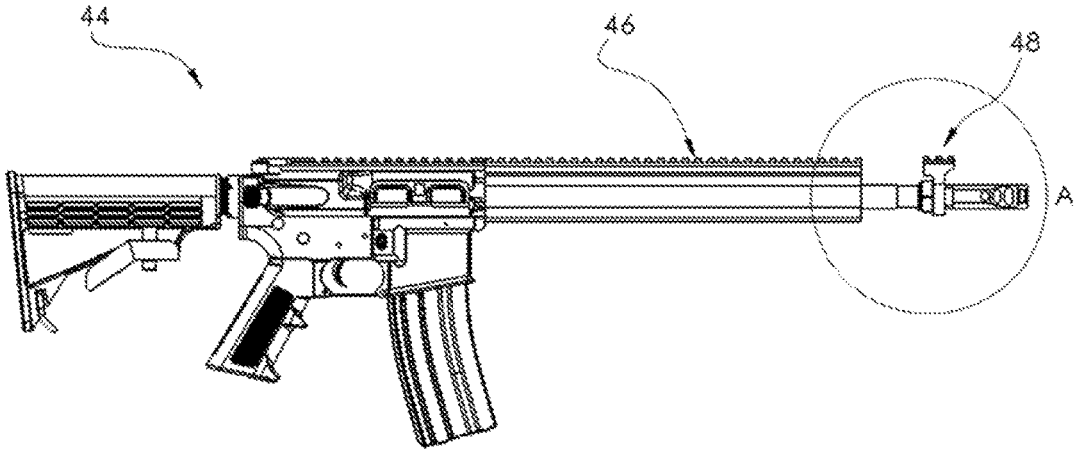
FIG. 3 is a side view of the system attached to an AR-15 style firearm.
Figure 4:
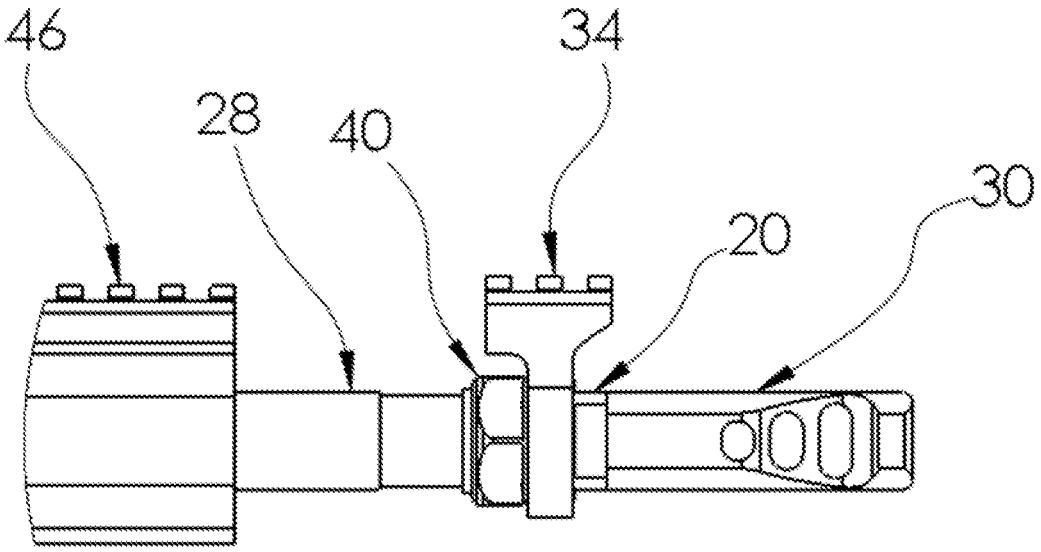
FIG. 4 is an exploded perspective view of the barrel system.

FIG. 3 and FIG. 4 show the extending system 48 mounted to an AR-15 style firearm 44. Instead of the standard front sight found on the AR-15, a handguard 46 extended past where the front sight would be placed. The system 48 is then placed on the firearm barrel 28 via the muzzle threading 42. The system 48 can be or be used to mount a front sight or other accessories forward on the handguard 46.

Figure 5:
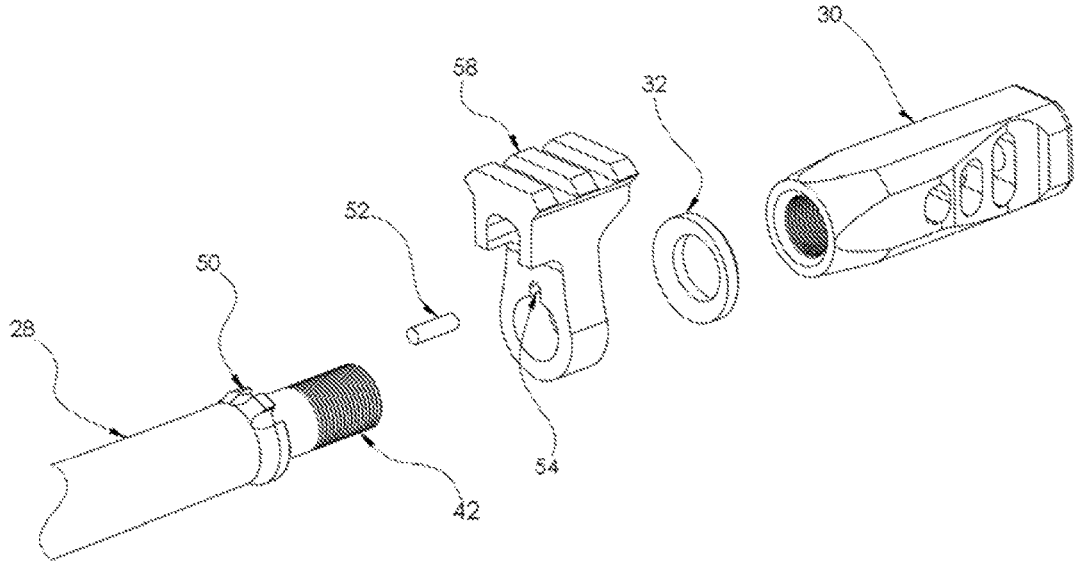
FIG. 5 is an extender system with an alignment pin.

FIG. 5 shows an alternate embodiment of the system called the barrel system. FIG. 5 shows a picatinny rail device 58 that can be attached to provide the zero relative movement between firearm accessories that utilize picatinny rails and the bore of the firearm. The extender in this case is replaced by a novel barrel 28 of the firearm. The device 58 is placed onto the barrel of the firearm 28 and aligned with a plurality of predefined notches 50 machined into a raised ring 56 integrated on the band 28. An alignment pin 52 is then fitted into the notch in the barrel 50 and a matching notch 54 in the device 34. The device 34 can also be indexed at a plurality of angles by removing the alignment pin 52 and turning the device 34 to line up with another of the plurality of predefined notches 50. To tighten the system for semi-permanent installation a crush washer 32 is then placed behind the device 34 and a muzzle device 30 is then tightened to a predefined torque. The predefined notches 50 can and alignment pin 52 with a device having a matching notch 54 can be combined with other elements to allow for continuous indexing that can be locked into specific reference points with the alignment pin 52. In this embodiment, the alignment pin could be removed so that it could operate just as the network described in FIG. 2. In the preferred embodiment, the raised ring 56 is completely immobile relative to the rest of the barrel, so that the raised ring 56 is the same continuous metal and is not welded onto the barrel.

Figure 8:
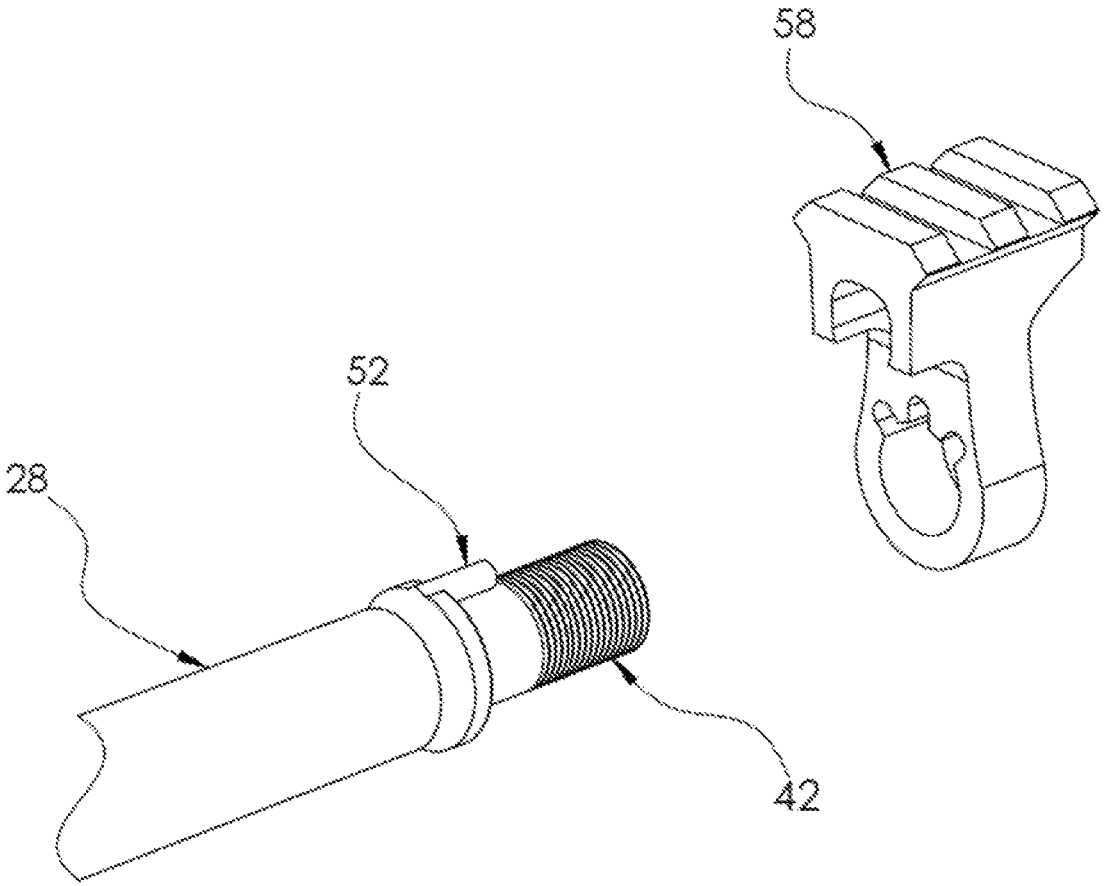
FIG. 8 is an embodiment of the extender system with an alignment pin fixed to a barrel.
Figure 9:
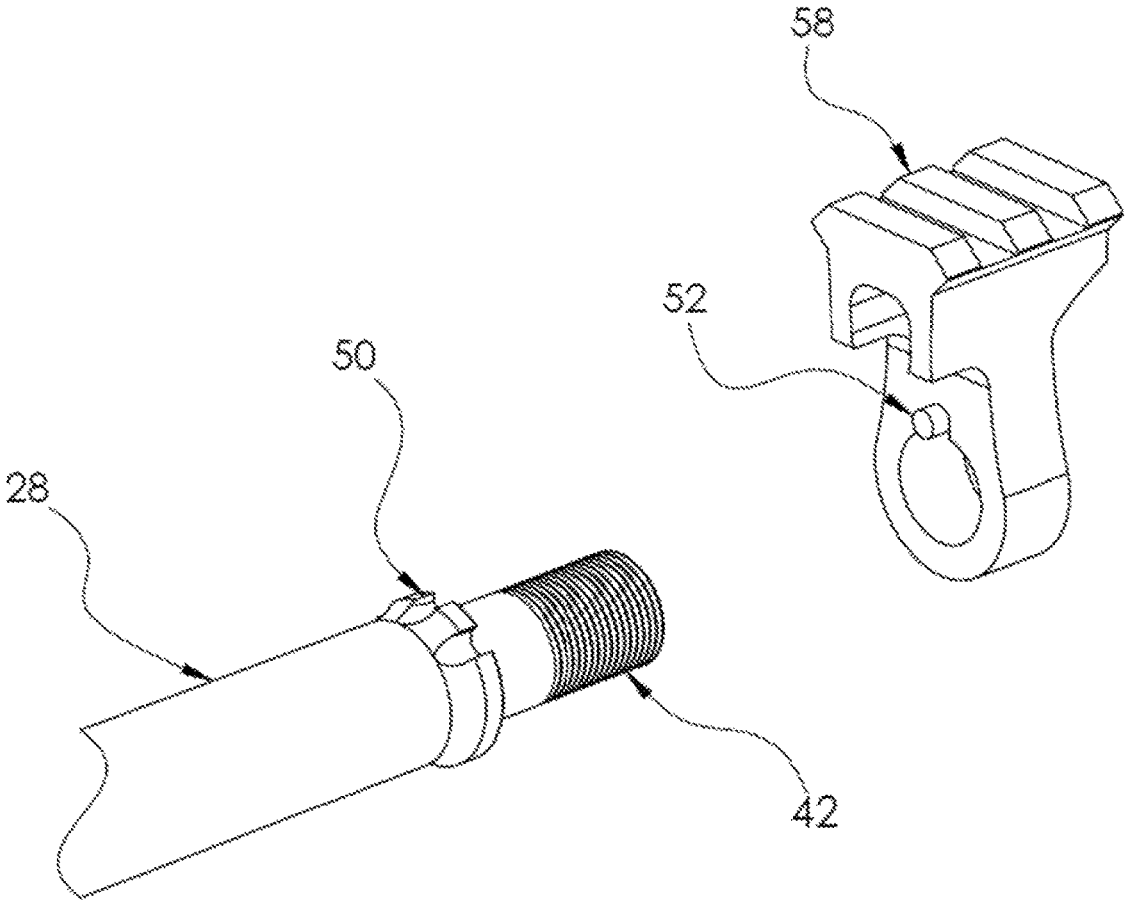
FIG. 9 is an embodiment of the extender system with an alignment pin fixed to a device.

FIG. 8 and FIG. 9 shows an alternative embodiment to what is shown in FIG. 5. In FIG. 8, the alignment pin 52 is fixed to the barrel. In FIG. 9, the alignment pin 52 is fixed to the device. In both FIG. 8 and FIG. 9, the pin remains fixed relative to either the device or gun barrel and locks into a fixed point on the corresponding item (either the device of the gun barrel).

Figure 6:
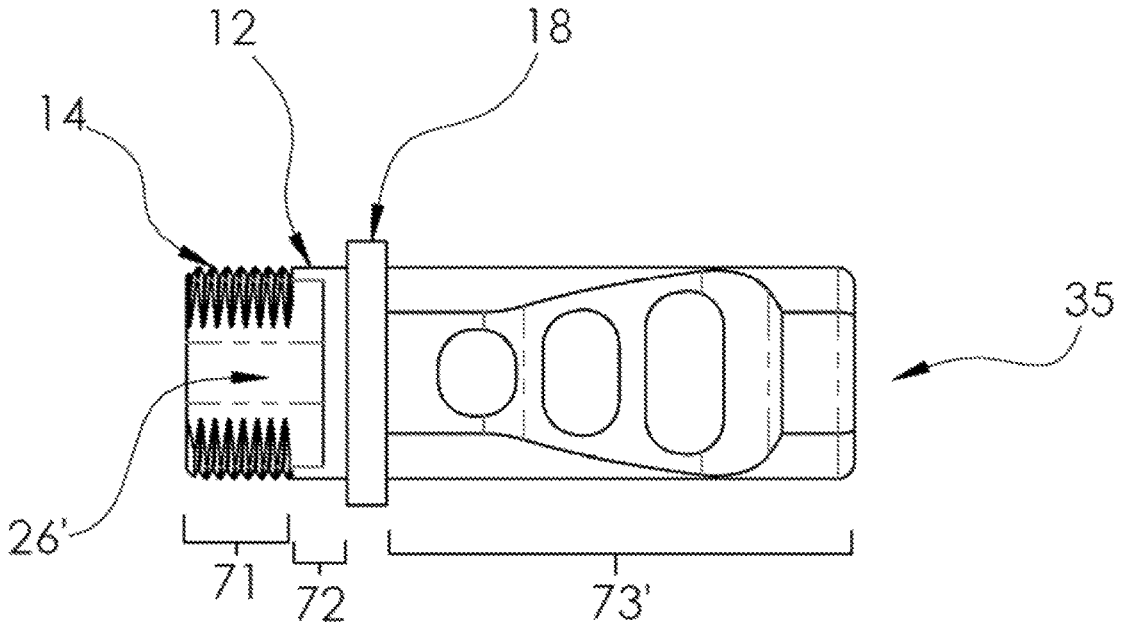
FIG. 6 is a sectional view an extender with a muzzle brake as the distal end.
Figure 7:
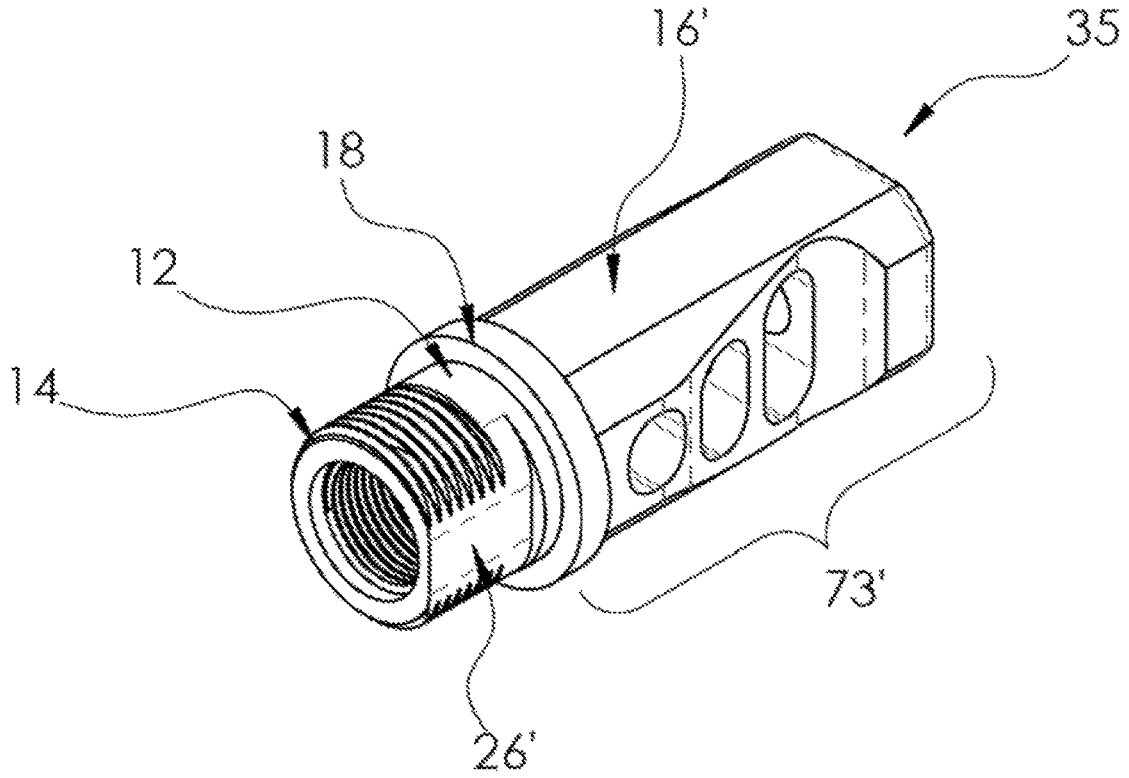
FIG. 7 is an extender with a muzzle brake as the distal end.

FIG. 6 and FIG. 7 show an alternative extender 35 that has a torque section with a single flat 26' that matches with a washer's flat. FIG. 6 and FIG. 7 shows an embodiment of the alternative extender 35 that has a distal end 73' that is a functional device, such as a muzzle brake with an alternative torque surface 16' that may extend along the distal end 73'.

The device 34 that is attached to the extender includes but are not limited to: flashlights, lasers, rangefinders, bipeds, and fore grips, grenade launchers/projectile launchers, optics, sights, bayonets, and glass breakers. It is particularly useful in devices that benefit from continuous clocking, such as sights.

Not shown are alternate devices that can be attached to the extender via the end threading 10 including, but not limited to: muzzle breaks, compensators, silencers, thread adaptors, flash hinders, thread, protectors, grenade launchers/projectile launchers, choke tubes, and bayonets.

The invention claimed is:

1. A barrel system comprising
a gun barrel having a threaded end;
a raised ring near the threaded end of the gun barrel, the raised ring having a plurality of notches;
a device having a matching notch;
an alignment pin configured to fit in any of the plurality of notches and the matching notch,
wherein the raised ring is structured to be integral to the gun barrel.

2. A barrel system comprising
a gun barrel having a threaded end;
a raised ring near the threaded end of the gun barrel, the raised ring having a plurality of notches;
a device having a matching notch;
an alignment pin configured to fit in any of the plurality of notches and the matching notch,
wherein the device is configured between the raised ring and an extending mechanism and the alignment pin is structured and configured to be removed to allow for continuous indexing.

* * * * *